US005678156A

United States Patent [19]

Lee

[11] Patent Number: 5,678,156

[45] Date of Patent: Oct. 14, 1997

[54] LIGHT SOURCE CONTROL METHOD FOR ELECTRONIC COPIER IN MANUAL TRAY MODE

[75] Inventor: Seung-Jae Lee, Gumi, Rep. of Korea

[73] Assignee: SamSung Electronics Co., Ltd., Suwon, Rep. of Korea

[21] Appl. No.: 647,418

[22] Filed: May 9, 1996

[30] Foreign Application Priority Data

May 10, 1995 [KR] Rep. of Korea ..... 11393

[51] Int. Cl.[6] ..... G03G 15/00

[52] U.S. Cl. ..... 399/376; 399/51

[58] Field of Search ..... 399/51, 177, 376, 399/365

[56] References Cited

U.S. PATENT DOCUMENTS

| | | | |
|---|---|---|---|
| 4,600,266 | 7/1986 | Omi . | |
| 4,692,019 | 9/1987 | Morimoto et al. | 399/376 |
| 4,695,154 | 9/1987 | Watanabe | 399/376 |
| 4,954,846 | 9/1990 | Matsuo et al. | 399/51 |
| 4,963,934 | 10/1990 | Nezu . | |
| 4,967,232 | 10/1990 | Obara . | |
| 5,218,408 | 6/1993 | Inada et al. | 399/376 |
| 5,223,904 | 6/1993 | Umezawa . | |
| 5,258,812 | 11/1993 | Mahoney . | |
| 5,541,713 | 7/1996 | Takatsuki et al. | 399/376 |

*Primary Examiner*—Sandra L. Brase
*Attorney, Agent, or Firm*—Robert E. Bushnell, Esq.

[57] ABSTRACT

A light source control method for an electronic copier includes the steps of: detecting a size of a document in response to input of a start key while the copier is in a manual tray copy mode; and moving an exposure lamp a given distance along a length of the document corresponding to the size of the document detected in the detecting step. The given distance equals a predetermined percentage of a reference value representative of a maximum scan distance of the exposure lamp.

21 Claims, 3 Drawing Sheets

LIGHT SOURCE CONTROL METHOD FOR ELECTRONIC COPIER IN MANUAL TRAY MODE

CROSS-REFERENCE TO RELATED APPLICATIONS

This application makes reference to, incorporates the same herein, and claims all benefits accruing under 35 U.S.C. §119 arising from an application for *Light Source Control Method For Electronic Copier In Manual Tray Mode* earlier filed in the Korean Industrial Property Office on 10 May 1995 and there duly assigned Ser. No. 11393/1995.

BACKGROUND OF THE INVENTION

The present invention relates to a light source control method for an electronic copier, and more particularly, to a light source control method for adaptively moving an exposure lamp according to the detected size of documents during a manual tray copy mode of the copier.

Generally, when producing a copy with an electronic copier employing an electrophotographic developing process, an exposure lamp of the electronic copier scans the entire length of its document bearing surface when the copier is in a manual tray copy mode, regardless of the size of the document being copied. For example, assuming that a maximum scan distance corresponds to an A3 sized document, when copying is performed with a document having a size smaller than A3 (e.g., A4), the exposure lamp still travels the maximum scan distance. This creates a problem, however, in that a users' eyes are caused to be unnecessarily exposed to light. Moreover, an extended scan distance increases the amount of time during which the exposure lamp is turned on, thereby causing an excessive consumption of electricity.

In order to solve this problem, there must be a means by which to detect the size of a document being reproduced. One prior art reference directed towards this concept is U.S. Pat. No. 5,258,812 entitled *Method And Mechanism For Document Size Determination Using An Advanceable Document Background Member* issued to Mahoney. In Mahoney '812, an electrostatographic reproduction apparatus includes a document size determining mechanism that employs an optical scanning unit for scanning an original document. While conventional art, such as Mahoney '812, is able to detect the size of an original document, I note that it still suffers from the aforementioned deficiencies since the optical scanning unit scans beyond the opposite edges of the original document.

SUMMARY OF THE INVENTION

Therefore, it is an object of the present invention to provide an improved light source control method for an electronic copier.

It is another object to provide a light source control method for adaptively moving an exposure lamp according to a scan distance corresponding to the detected size of a document.

It is still another object to provide a light source control method for an electronic copier that reduces unnecessary strain on a user's eyes.

It is yet another object to provide a light source control method for an electronic copier that reduces the consumption of electricity.

To achieve these and other objects, the present invention provides a light source control method for an electronic copier. By detecting a size of a document in response to input of a start key while the copier is in a manual tray copy mode; and moving an exposure lamp a given distance along a length of the document corresponding to the size of the document detected in the detecting step. The given distance equals a predetermined percentage of a reference value representative of a maximum scan distance of the exposure lamp.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
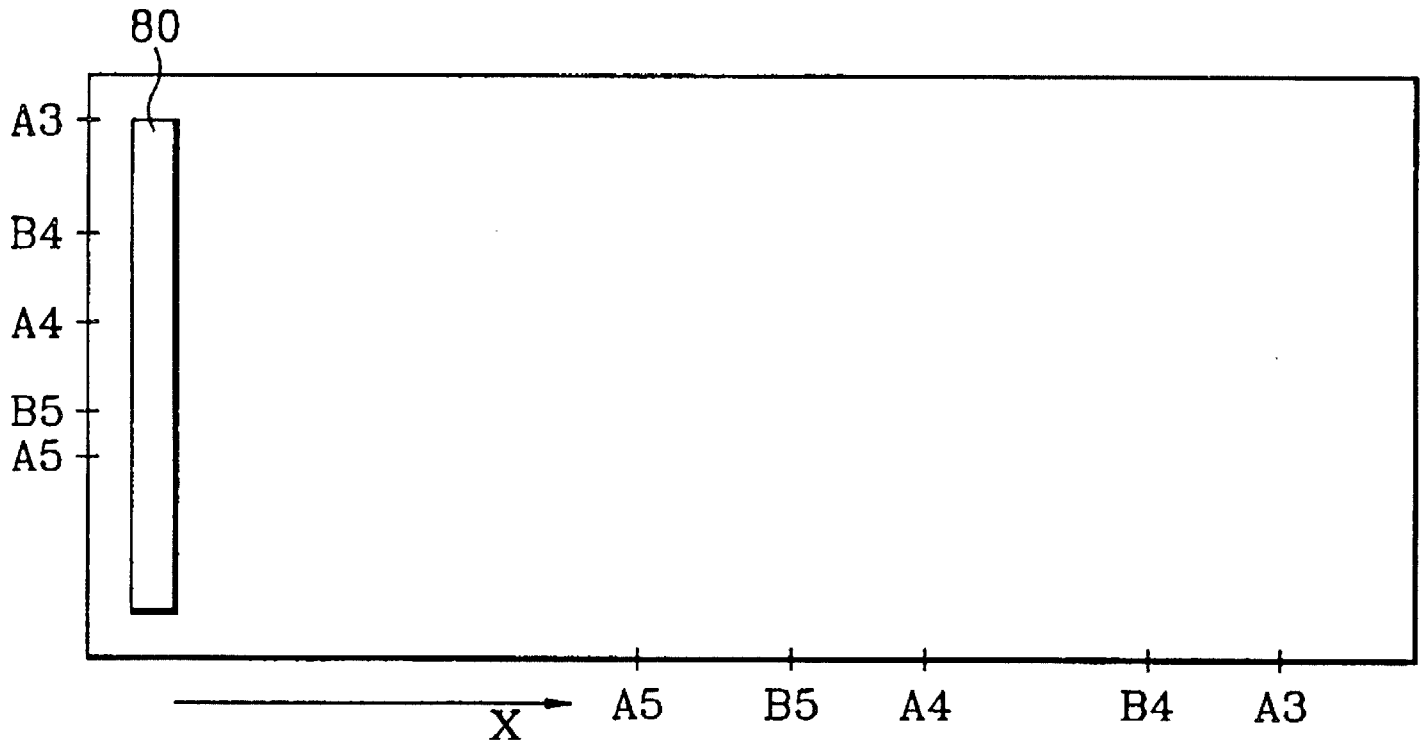
FIG. 1 is a diagram of a document bearing surface of a copier.

Turning now to the drawings and referring to FIG. 1, a diagram of a document bearing surface of a copier upon which documents are laid for copying is shown. As indicated by FIG. 1, documents to be copied have various lengths. Paper sizes, such as A5, A4, A3, B5 and B4 are currently used. These sizes are indicated along the vertical and horizontal lengths of the document bearing surface. During copying an exposure lamp 80 is moved in the "x" direction indicated by the arrow to scan the document being copied.

Figure 2:
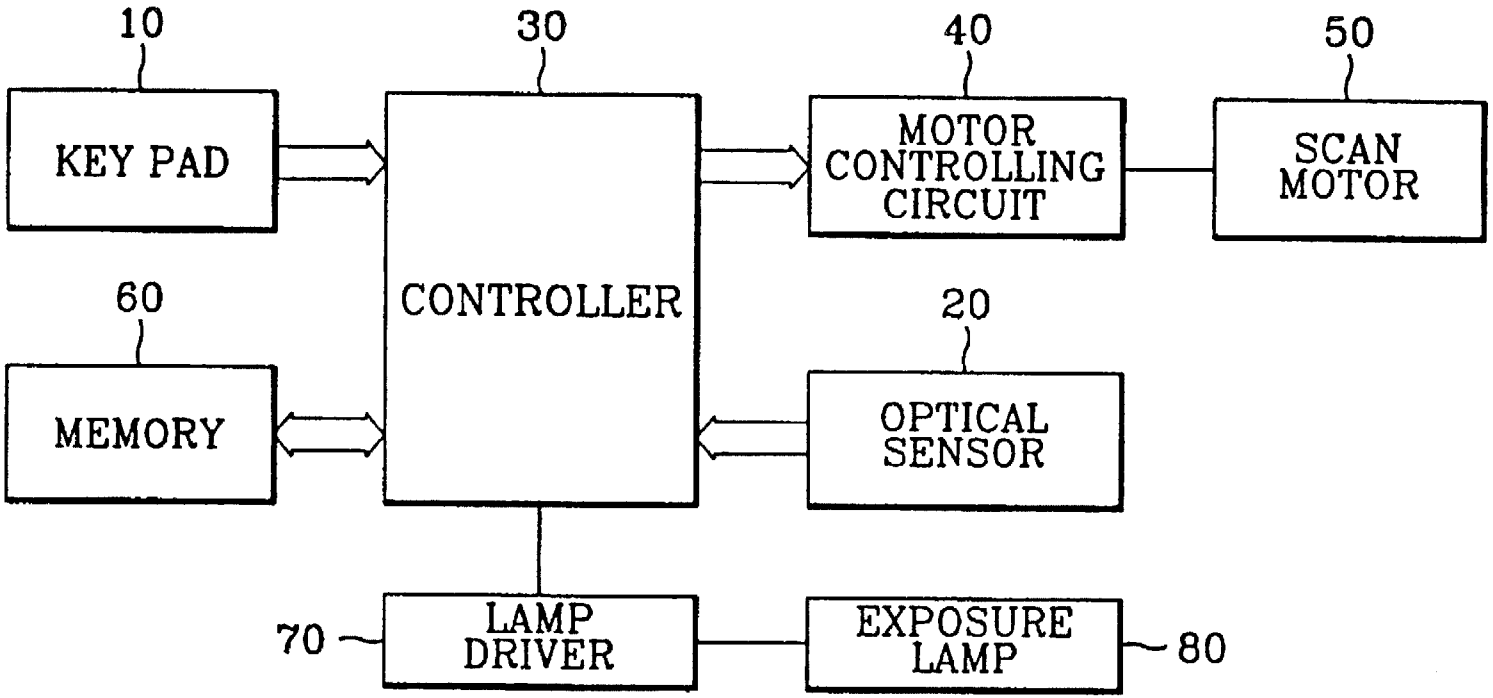
FIG. 2 is a block diagram of a copier constructed according to the principles of the present invention.

FIG. 2 is a block diagram of a copier constructed according to the principles of the present invention. The copier of FIG. 2 includes a key pad 10 having a plurality of keys, such as a clear key, a start key, a stop key, and a key for designating the number of copies desired. An optical sensor 20 detects the size of documents to be copied. A controller 30 receives key signals from key pad 10 to control various copying operations, and receives a signal detected from optical sensor 20 to generate a scan motor driving signal. A motor controlling circuit 40 is connected to controller 30, and drives a scan motor 50 in accordance with the scan motor driving signal provided from controller 30. A memory 60 stores a program to control the source of light, and also temporarily stores data generated while the program is performed. A lamp driver 70 controls on and off functions of exposure lamp 80 by a control voltage provided from controller 30.

Among the components shown in FIG. 2, optical sensor 20 detects the size of the document, for example, A5, A4, A3, B5 and B4, as shown in FIG. 1. This technique of detecting document sizes is well-known in the art, and is described in detail in Korean Patent Application No. 9150 filed in 1990 by the Applicant.

Figure 3:
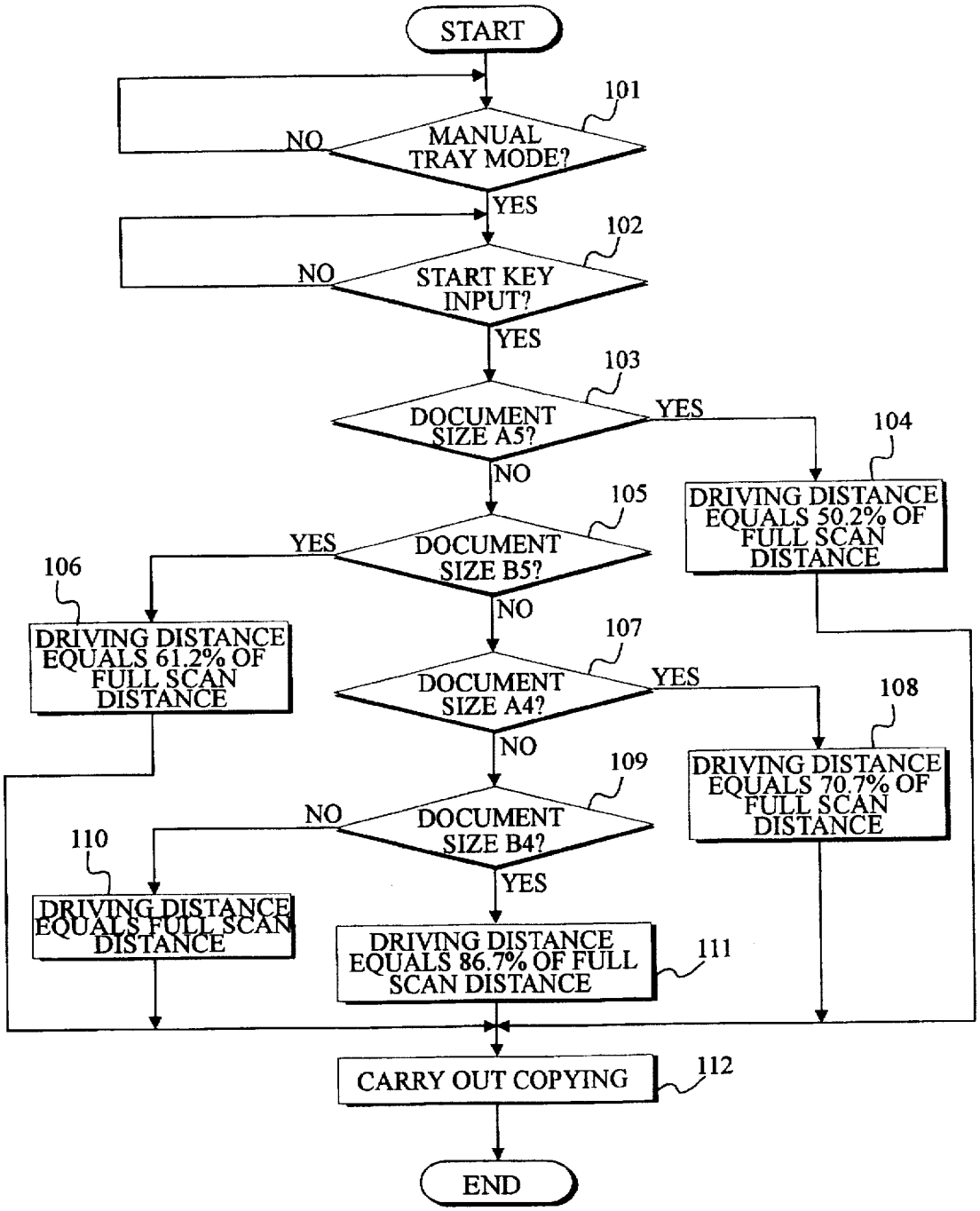
FIG. 3 is a flowchart of a method for controlling the light source according to the principles of the present invention.

Referring to FIG. 3, a flowchart of a method for controlling the light source according to the principles of the present invention is shown. The operation of the present invention will now be discussed with reference to FIGS. 1 through 3.

First, in step 101, controller 30 determines whether the copier is set to a manual tray copy mode. That is, controller 30 determines whether the copier is set to generate copies of documents laid upon its document bearing surface. When the manual tray mode is set, controller 30 determines whether the start key for initiating copying is input from keypad 10, in step 102. When the start key is input, controller 30 first determines whether an A5-sized document is detected by optical sensor 20, in step 103. If an A5-sized document is detected, data stored in memory 60 indicating that the driving distance of exposure lamp 80 equals 50.2% of a full scan distance is read out for transmission to motor driving circuit 40, in step 104. Controller 30 turns on exposure lamp 80 by driving lamp driver 70. Motor driving circuit 40 then drives scan motor 50 to move exposure lamp 80 in the "x" direction shown by the arrow in FIG. 1. Since an A5-sized document was detected, exposure lamp 80 is moved in the "x" direction only by a distance corresponding to the length of the A5 document (i.e., 211 mm). In the present invention, an A3-sized document having a length of 420 mm is used as a reference to represent the full scan distance. Therefore, driving distances for exposure lamp 80 are based on a percentage of the full scan distance. After step 104, the copying procedure is carried out, in step 112.

When the document size detected in step 103 is not A5, controller 30 determines whether a B5-sized document is detected by optical sensor 20, in step 105. If a B5-sized document is detected, data stored in memory 60 indicating that the driving distance of exposure lamp 80 equals 61.2% of the full scan distance is read out for transmission to motor driving circuit 40, in step 106. Accordingly, motor driving circuit 40 drives scan motor 50 to move exposure lamp 80 in the "x" direction only by a distance corresponding to the length of the B5 document (i.e., 257 mm). After step 106, the copying procedure is carried out, in step 112.

When the document size detected in step 105 is not B5, controller 30 determines whether an A4-sized document is detected by optical sensor 20, in step 107. If an A4-sized document is detected, data stored in memory 60 indicating that the driving distance of exposure lamp 80 equals 70.7% of the full scan distance is read out for transmission to motor driving circuit 40, in step 108. Accordingly, motor driving circuit 40 drives scan motor 50 to move exposure lamp 80 in the "x" direction only by a distance corresponding to the length of the A4 document (i.e., 297 mm). After step 108, the copying procedure is carried out, in step 112.

When the document size detected in step 107 is not A4, controller 30 determines whether a B4-sized document is detected by optical sensor 20, in step 109. If a B4-sized document is detected, data stored in memory 60 indicating that the driving distance of exposure lamp 80 equals 86.7% of the full scan distance is read out for transmission to motor driving circuit 40, in step 111. Accordingly, motor driving circuit 40 drives scan motor 50 to move exposure lamp 80 in the "x" direction only by a distance corresponding to the length of the B4 document (i.e., 364 mm). After step 111, the copying procedure is carried out, in step 112.

When the document size detected in step 109 is not B4, controller 30 reads data stored in memory 60 indicating that the driving distance of exposure lamp 80 is equal to the full scan distance for transmission to motor driving circuit 40, in step 110. Accordingly, motor driving circuit 40 drives scan motor 50 to move exposure lamp 80 in the "x" direction by the full scan distance, which corresponds to the length of the B3 document (i.e., 420 mm). After step 110, the copying procedure is carried out, in step 112.

When the document sizes are detected by optical sensor 20 in steps 103, 105, 107, and 109, scan driving data corresponding to the sizes are read from memory 60. This data is represented in the following Table 1.

TABLE 1

| DOCUMENT SIZE | DRIVING DATA (as a %) |
|---|---|
| A3 | 100 |
| B4 | 86.7 |
| A4 | 70.7 |
| B5 | 61.2 |
| A5 | 50.2 |

Again, it is noted that the data of Table 1 represents percentage sizes, not actual sizes, based on a reference percentage of 100%, which corresponds to the length of an A3-sized document.

As described above, when the copier is in the manual tray copy mode, the present invention advantageously reduces the consumption of electricity and prevents unnecessary strain on a user's eyes attributable to an excessive exposure of light by adjusting the traveling distance of exposure lamp 80.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A light source control method for an electronic copier, comprising the steps of:

detecting a size of a document in response to input of a start key while said copier is in a manual tray copy mode; and moving an exposure lamp a given distance along a length of the document corresponding to the size detected in said detecting step, said given distance equaling a predetermined percentage of a reference value representative of a maximum scan distance of said exposure lamp.

2. A method for controlling an exposure lamp in a photocopying device, comprising the steps of:

determining whether a start key is input while said photocopying device is in a manual tray copy mode;

determining whether a document to be copied exhibits a first predetermined size in response to the input of said start key;

reading first data stored in a memory indicating that a traveling distance of said exposure lamp equals a first predetermined percentage of a full scan distance, when said document exhibits said first predetermined size;

determining whether said document exhibits a second predetermined size, when said document does not exhibit said first predetermined size;

reading second data stored in said memory indicating that said traveling distance of said exposure lamp equals a second predetermined percentage of said full scan distance, when said document exhibits said second predetermined size;

determining whether said document exhibits a third predetermined size, when said document does not exhibit said second predetermined size;

reading third data stored in said memory indicating that said traveling distance of said exposure lamp equals a third predetermined percentage of said full scan distance, when said document exhibits said third predetermined size;

determining whether said document exhibits a fourth predetermined size, when said document does not exhibit said third predetermined size;

reading fourth data stored in said memory indicating that said traveling distance of said exposure lamp equals a fourth predetermined percentage of said full scan distance, when said document exhibits said fourth predetermined size; and concluding that said traveling distance of said exposure lamp equals said full scan distance, when said document does not exhibit said fourth predetermined size.

3. The method as claimed in claim 2, wherein said first predetermined size is smaller than said second predetermined size, said second predetermined size is smaller than said third predetermined size, and said third predetermined size is smaller than said fourth predetermined size.

4. The method as claimed in claim 2, wherein said first predetermined size corresponds to an A5-sized document.

5. The method as claimed in claim 4, wherein said first predetermined percentage equals 50.2%.

6. The method as claimed in claim 2, wherein said second predetermined size corresponds to a B5-sized document.

7. The method as claimed in claim 6, wherein said second predetermined percentage equals 61.2%.

8. The method as claimed in claim 2, wherein said third predetermined size corresponds to an A4-sized document.

9. The method as claimed in claim 8, wherein said third predetermined percentage equals 70.7%.

10. The method as claimed in claim 2, wherein said fourth predetermined size corresponds to a B4-sized document.

11. The method as claimed in claim 10, wherein said fourth predetermined percentage equals 86.7%.

12. The method as claimed in claim 2, wherein said full scan distance corresponds to a length of an A3-sized document.

13. An electronic copier, comprising:

an optical sensor for detecting a size of a document to be copied;

a memory for storing predetermined data;

a key input unit having a plurality of keys for providing key inputs;

an exposure lamp for exposing said document with light; and a controller for controlling operations of said copier, said controller determining whether a start key is input from said key input unit while said copier is in a manual tray copy mode, determining whether said document exhibits a first predetermined size in response to the input of said start key, reading first data stored in said memory indicating that a traveling distance of said exposure lamp equals a first predetermined percentage of a full scan distance when said document exhibits said first predetermined size, determining whether said document exhibits a second predetermined size when said document does not exhibit said first predetermined size, reading second data stored in said memory indicating that said traveling distance of said exposure lamp equals a second predetermined percentage of said full scan distance when said document exhibits said second predetermined size, determining whether said document exhibits a third predetermined size when said document does not exhibit said second predetermined size, reading third data stored in said memory indicating that said traveling distance of said exposure lamp equals a third predetermined percentage of said full scan distance when said document exhibits said third predetermined size, determining whether said document exhibits a fourth predetermined size when said document does not exhibit said third predetermined size, reading fourth data stored in said memory indicating that said traveling distance of said exposure lamp equals a fourth predetermined percentage of said full scan distance when said document exhibits said fourth predetermined size, and determining that said traveling distance of said exposure lamp equals said full scan distance when said document does not exhibit said fourth predetermined size.

14. The copier as claimed in claim 13, wherein said first predetermined size corresponds to an A5-sized document.

15. The copier as claimed in claim 14, wherein said first predetermined percentage equals 50.2%.

16. The copier as claimed in claim 15, wherein said second predetermined size corresponds to a B5-sized document.

17. The copier as claimed in claim 16, wherein said second predetermined percentage equals 61.2%.

18. The copier as claimed in claim 17, wherein said third predetermined size corresponds to an A4-sized document.

19. The copier as claimed in claim 18, wherein said third predetermined percentage equals 70.7%.

20. The copier as claimed in claim 19, wherein said fourth predetermined size corresponds to a B4-sized document.

21. The copier as claimed in claim 20, wherein said fourth predetermined percentage equals 86.7%.

* * * * *